United States Patent [19]

Emanuelsson et al.

[11] 4,088,427

[45] May 9, 1978

[54] ROTORS FOR A SCREW ROTOR MACHINE

[75] Inventors: Kaj Bengt Ingemar Emanuelsson, Wilrijk, Belgium; Sven Evald Eriksson, Orebro, Sweden

[73] Assignee: Atlas Copco Aktiebolag, Nacka, Sweden

[21] Appl. No.: 722,645

[22] Filed: Sep. 13, 1976

Related U.S. Application Data

[63] Continuation-in-part of Ser. No. 551,072, Feb. 20, 1975, abandoned.

[30] Foreign Application Priority Data

Jun. 24, 1974 Sweden ..... 7408229

[51] Int. Cl.[2] ..... F04C 17/12

[52] U.S. Cl. ..... 418/201

[58] Field of Search ..... 418/150, 201

[56] References Cited

U.S. PATENT DOCUMENTS

| | | | |
|---|---|---|---|
| 3,314,598 | 4/1967 | Lysholm | 418/201 |
| 3,414,189 | 12/1968 | Persson | 418/201 |
| 3,423,017 | 1/1969 | Schibbye | 418/201 |
| 3,640,649 | 2/1972 | Persson | 418/201 X |

*Primary Examiner*—Carlton R. Croyle
*Assistant Examiner*—Leonard Smith
*Attorney, Agent, or Firm*—Eric Y. Munson

[57] ABSTRACT

A pair of cooperating rotors for a screw rotor machine, comprising a main rotor with a dedendum and a gate rotor with an addendum. One flank of each gate rotor land is generated inside the pitch circle of the gate rotor by the crest of the main rotor land and is generated outside the pitch circle by a portion of the main rotor inside the pitch circle and is formed to sealingly cooperate with the main rotor land so that gear action is obtained only outside the pitch circle of the gate rotor and inside the pitch circle of the main rotor.

16 Claims, 8 Drawing Figures

ROTORS FOR A SCREW ROTOR MACHINE

This is a Continuation-in-Part of co-pending application Ser. No. 551,072 filed Feb. 20, 1975, now abandoned.

BACKGROUND OF THE INVENTION

The present invention relates to screw rotor machines. More specifically, the invention concerns a pair of cooperating rotors for such machines.

In order to increase the volumetric efficiency of a screw compressor, i.e. to increase the delivered amount of air per rotor revolution, it is common to provide the gate rotor with an addendum located outside the pitch circle and the main rotor with a corresponding dedendum located inside the pitch circle. When the gate rotor is provided with such an addendum, a so-called blow-hole is created through which working fluid leaks from a high pressure working chamber to a low pressure working chamber. It is important that this leakage is kept at a minimum in order not to impair the efficiency of the machine.

When screw rotor machines are designed for liquid injection for cooling of the working fluid and for sealing between the rotors and between the rotors and the machine housing, respectively, it is common to exclude the synchronizing gears which otherwise are used to make certain that the rotors rotate without mutual contact. When the rotors are designed to be driven with mutual contact, the rotor profiles must be designed so that gear action is achieved along a portion of the rotor flanks. In previously known rotors of this type, the rotors have been designed so that gear action is achieved inside the pitch circle of the gate rotor flank which is essential for the size of the blow-hole and outside the pitch circle of the main rotor flank which is essential for the size of the blow-hole. Such a design results in a comparatively large blow-hole.

SUMMARY OF THE INVENTION

The present invention relates to a pair of cooperating rotors for a screw rotor machine such as a compressor, a pump or a motor, in which the gate rotor is provided with an addendum and the main rotor with a corresponding dedendum to increase the volumetric efficiency of the machine. These rotors are suitable both for liquid injected screw rotor machines without synchronizing gears and for screw rotor machines with synchronizing gears. By designing the rotors as described and defined herein, a screw rotor machine is obtained in which the size of the blow-hole area is very close to the smallest possible minimum when the gate rotor is provided with an addendum.

DESCRIPTION OF SPECIFIC EMBODIMENTS OF THE INVENTION

Figure 1:
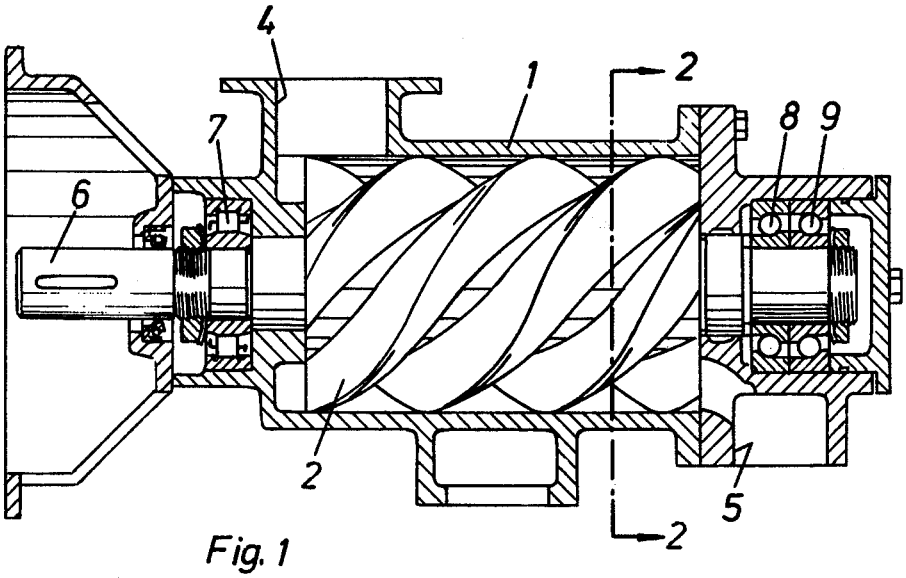
FIG. 1 is a longitudinal section of a screw compressor.
Figure 2:
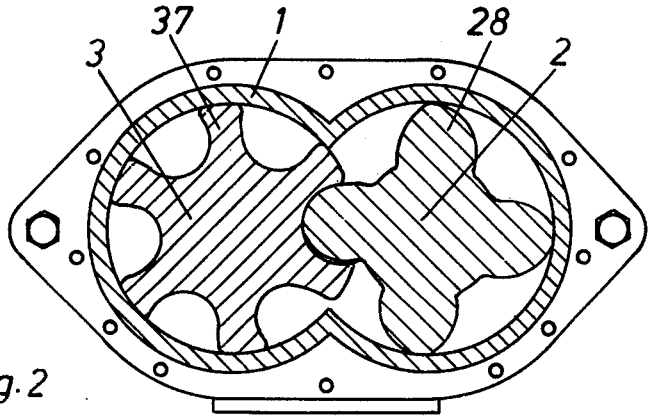
FIG. 2 shows a section taken along 2—2 in FIG. 1.

The screw compressor shown in FIGS. 1 and 2 comprises a housing 1 in which a main rotor 2 and a gate rotor 3 and journalled by means of bearings 7, 8 and 9. The bearings for the main rotor, only, are shown. The main rotor is provided with four helical lands 28 and intervening grooves. The gate rotor is provided with six helical lands 37 and intervening grooves. The main rotor 2 is provided with a shaft 6 to which a motor can be connected either directly or via a gear train for driving the compressor. The gate rotor 3 is driven by the main rotor 2 through cooperation between the lands 28 and 37. During operation of the compressor, working medium is conveyed from the inlet channel 4 to the outlet channel 5 while being simultaneously compressed.

One embodiment of the pair of rotors according to the invention will now be described with reference to FIGS. 3 and 4. The lands 28 of the main rotor 2 comprise a first flank which extends from the point 21 located inside the pitch circle 12 to the point 24 located outside the pitch circle and a second flank which extends from the point 24 to the point 27. Portions 29 of a dedendum circle extend between the lands 28. The first flank of the main rotor comprises a first portion which extends from the crest 42 of the main rotor land, which in this embodiment comprises the edge 24, to the point 23 on the pitch circle 12. This portion is generated by the edge 32 on the gate rotor 3. The first flank of the main rotor also comprises a second portion which extends between the points 21, 22 and 23. The latter portion comprises a substantially radial section which, in this embodiment, is directed towards the rotation center 20 of the main rotor 2 and a concavely curved section between the points 21 and 22, which section is generated by the edge 31 on the gate rotor 3. The second flank of the main rotor comprises between the points 24 and 25 an arc whose center is located at the point 15 on the pitch circle 12. The section between the points 25 and 26 on the main rotor is generated by the section between the points 34 and 35 on the gate rotor 3. The second flank of the main rotor comprises, additionally, a circular portion which extends between the points 26 and 27. The center of the circle is located on the pitch circle 12.

Figure 3:
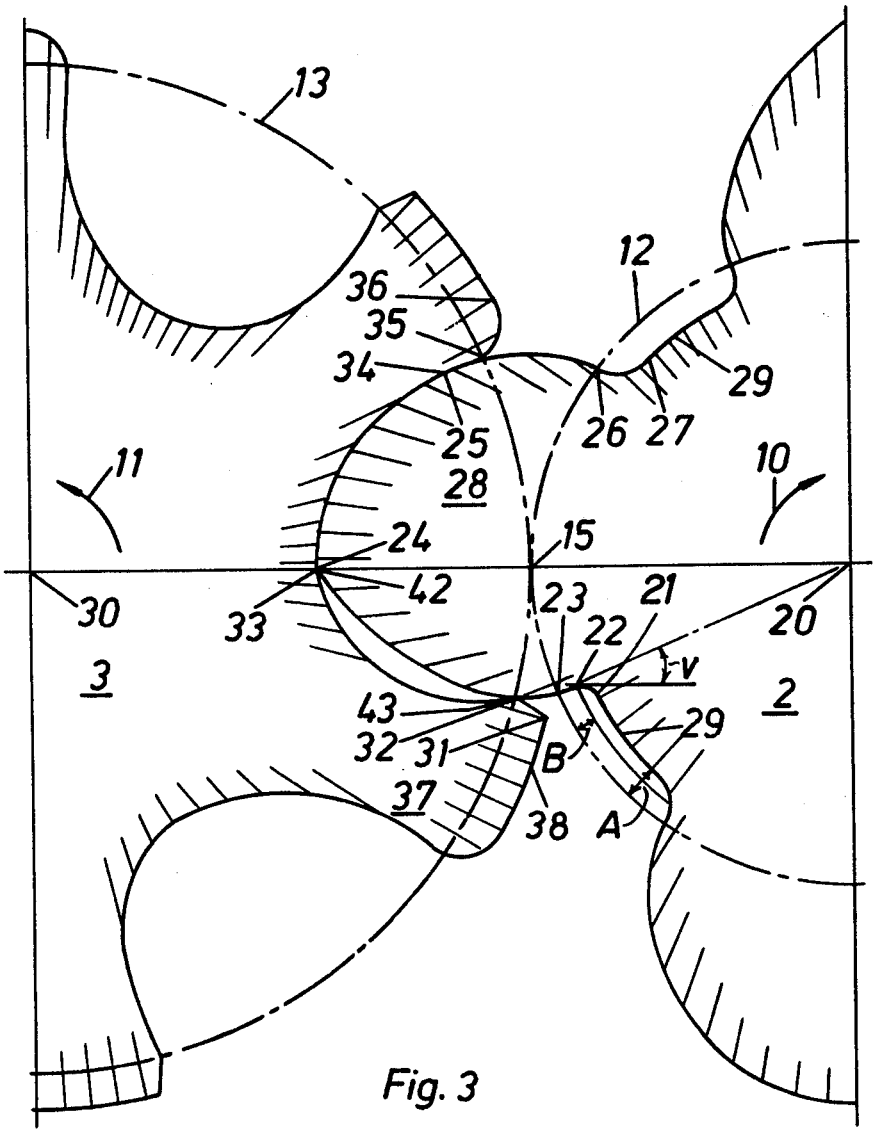
FIG. 3 is a fractional sectional view of a pair of rotors embodying the invention.

In the specific embodiment shown in FIG. 3, the depth of the dedendum 29 from the pitch circle is indicated by reference A. The reference B denotes the distance between the pitch circle and an arbitrarily selected point on the second portion 21–23. The angle between a radius through this arbitrary point and the tangent to the curve of portion 21–23 at the arbitrary point has been denoted by $v$. It will be noted that the apex of this angle is located on the curve 21–23 at the distance B from the pitch circle. The angle should not exceed 20° for values of B not exceeding two-thirds of the dedendum depth A. Thus, $B/A \leqq \frac{2}{3}$: $V \leqq 20°$. The curve 21–23 may have any form complying with this condition.

Figure 8:
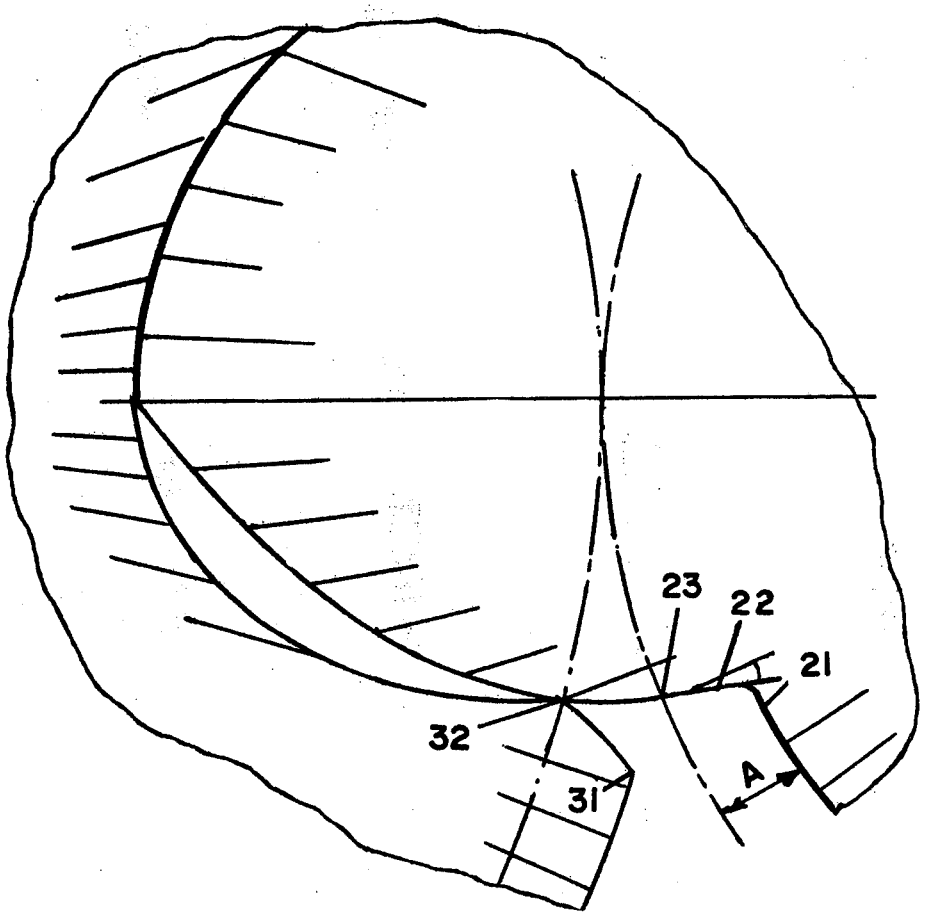
FIG. 8 is a view similar to FIG. 7, showing a modification.

In the specific embodiment of FIG. 3, the radial section 22–23 of the second portion is shown as a straight line. It should be apparent, however, that the radial portion may deviate somewhat from a straight line without departing from the invention. As stated herein, the principal object of the radial portion 22–23 is to generate the section between points 31–32 of the gate rotor. Furthermore, while the radial section is shown in FIG. 3 as being directed towards the center of rotation, it may deviate from a radial line within an angle not greater than 20° as shown in FIG. 8. Therefore, the section 22–23 has been described herein as extending substantially radially towards the center of rotation of the main rotor, which means that it may deviate from a radial line at an angle varying between 0° to 20°.

Figure 5:
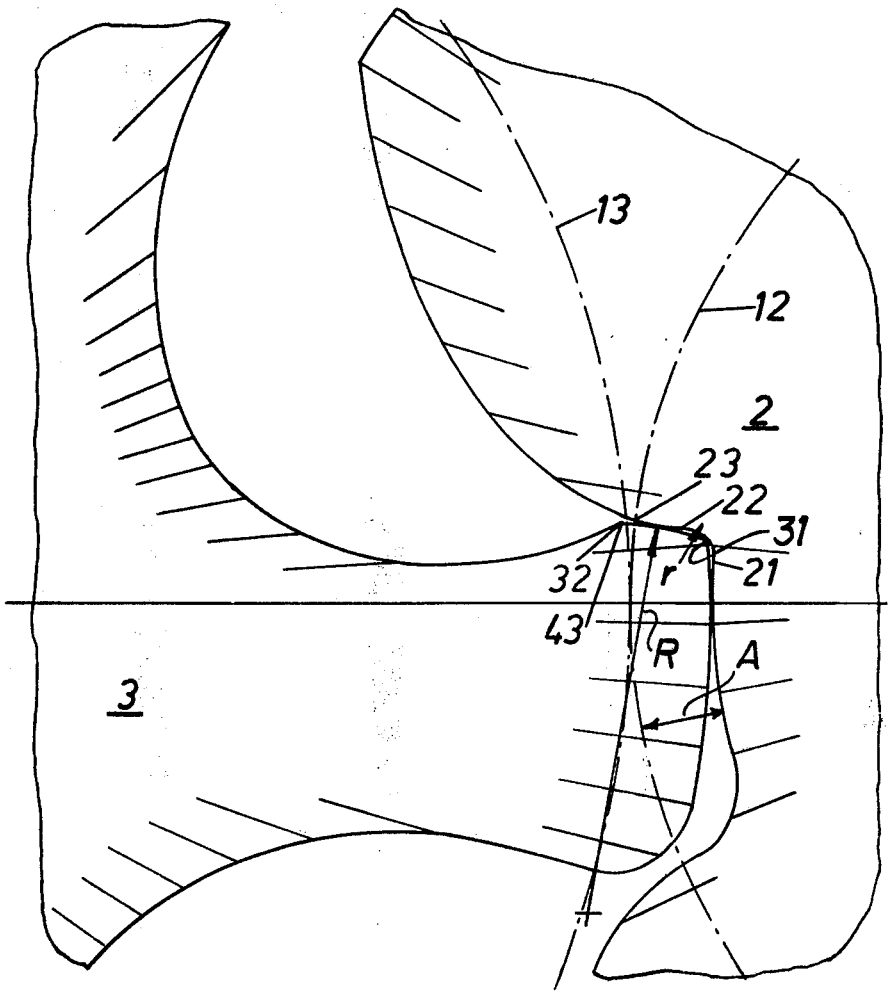
FIG. 5 is a fractional sectional view of a pair of rotors in which the gear cooperation between the rotors is shown.

It will also be apparent from FIG. 3, and more emphasized in FIG. 5, that the concavely curved section 21–22 is an epicycloid having a shorter local radius than the radial section 22–23.

It will be noted from FIG. 5 that the two sections 21–22 and 22–23, both inside the pitch circle, have substantially different radii. By way of example, the section 22–23 is shown as a circular arc having a radius R, which is five times the depth A of the dedendum, but can of course also be non-circular; the section 21–22, which is generated by point 31 on the gate rotor, has a local radius *r*. For practical reasons, the ratio R/*r should be greater than* 3.

The lands 37 of the gate rotor 3 comprise a first flank which extends from the point 31 located outside the pitch circle 13 to the point 33 located inside the pitch circle at the bottom of the gate rotor groove. Furthermore, the gate rotor lands 37 comprise a second flank which extends from the point 33 to the point 36. The gate rotor grooves are complements to the gate rotor lands so that the description of the profile form is valid both for the lands and the grooves. The first flank of the gate rotor comprises a first portion which extends from the point 32 to the point 33 which portion is generated by the edge 24 on the main rotor land 28. Furthermore, the first flank of the gate rotor comprises a second portion which extends from the point 31 to the point 32 and is generated by the radial line section between the points 22 and 23 on the main rotor 2. The edge 32 forms a transition 43 between the first and second portions of the first flank of the gate rotor. The second flank of the gate rotor land comprises between the points 33 and 34 an arc whose center is located at the point 15 on the pitch circle 13. Furthermore, the second flank of the gate rotor comprises a straight line portion between the points 34 and 35, which portion is directed towards the rotation center 30 of the gate rotor 3. The second flank of the gate rotor comprises between the points 35 and 36 an arc whose center is located on the pitch circle 13. The gate rotor, furthermore, comprises crests 38.

Figure 4:
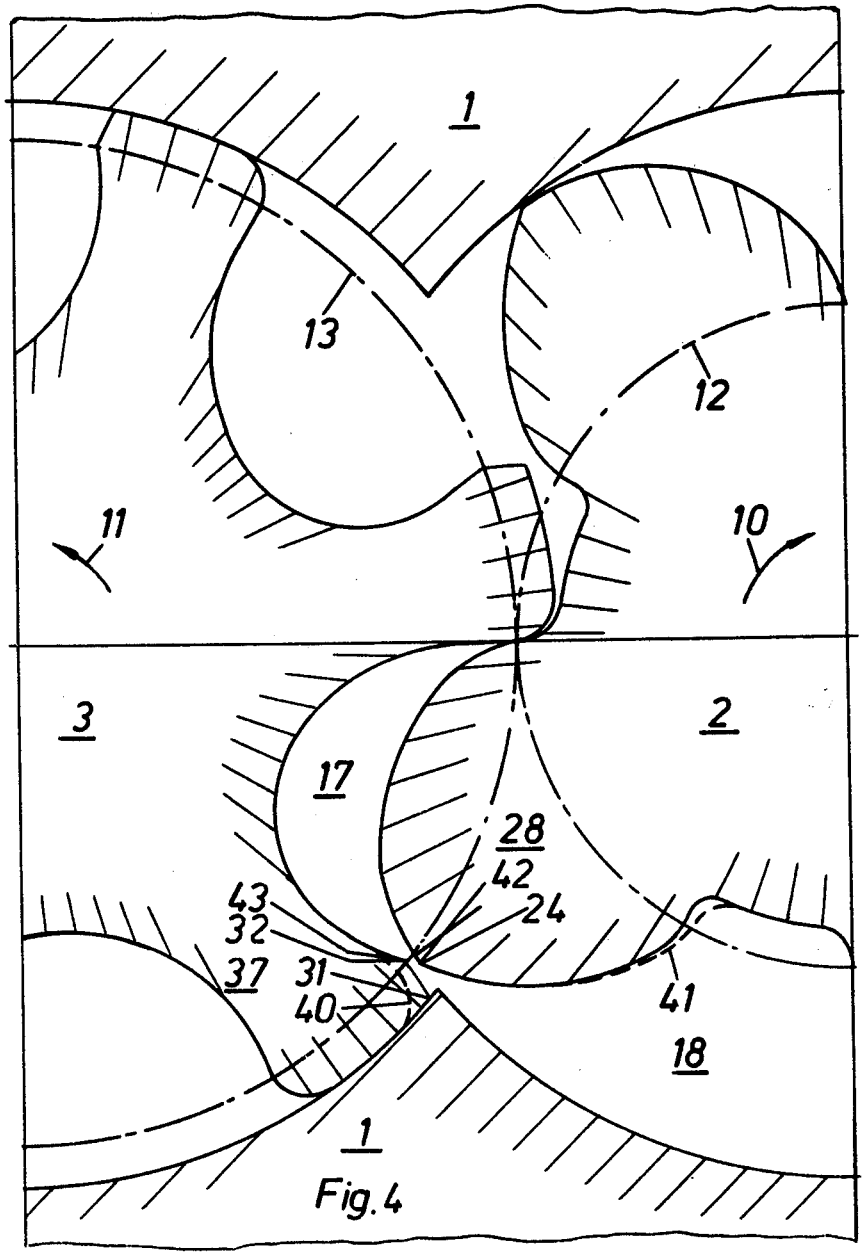
FIG. 4 is a fractional sectional view of a compressor showing the rotors in the position where a blow-hole is created.

In FIG. 4, the rotors are shown in the positions they assume after the edge 24 of the main rotor land 28 has left its sealing engagement with the housing 1, but before sealing engagement with the gate rotor land 37 has been obtained. In this position, gas flows from the chamber 17 to the chamber 18 through the blow-hole formed between the main rotor land 28 and the gate rotor land 37.

The above described design of the rotor profiles results in the formation of a minimum blow-hole area and in improved gear action. The dotted lines 40 and 41 in FIG. 4 show by way of example a known design of rotor profiles in which gear cooperation is obtained inside the pitch circle of the gate rotor and outside the pitch circle of the main rotor. As is clearly shown in FIG. 4, the blow-hole is considerably larger in the previously known design of rotor profiles.

In FIG. 5, the radial section between the points 22 and 23 on the main rotor is shown as a curve which generates the section between the points 31 and 32 on the gate rotor simultaneously as the edge 31 on the gate rotor generates the curved portion between the points 21 and 22 on the main rotor. This improved gear cooperation results from the built up gas pressure in the chamber 17 which strives to rotate the gate rotor 3 counterclockwise.

Figure 6:
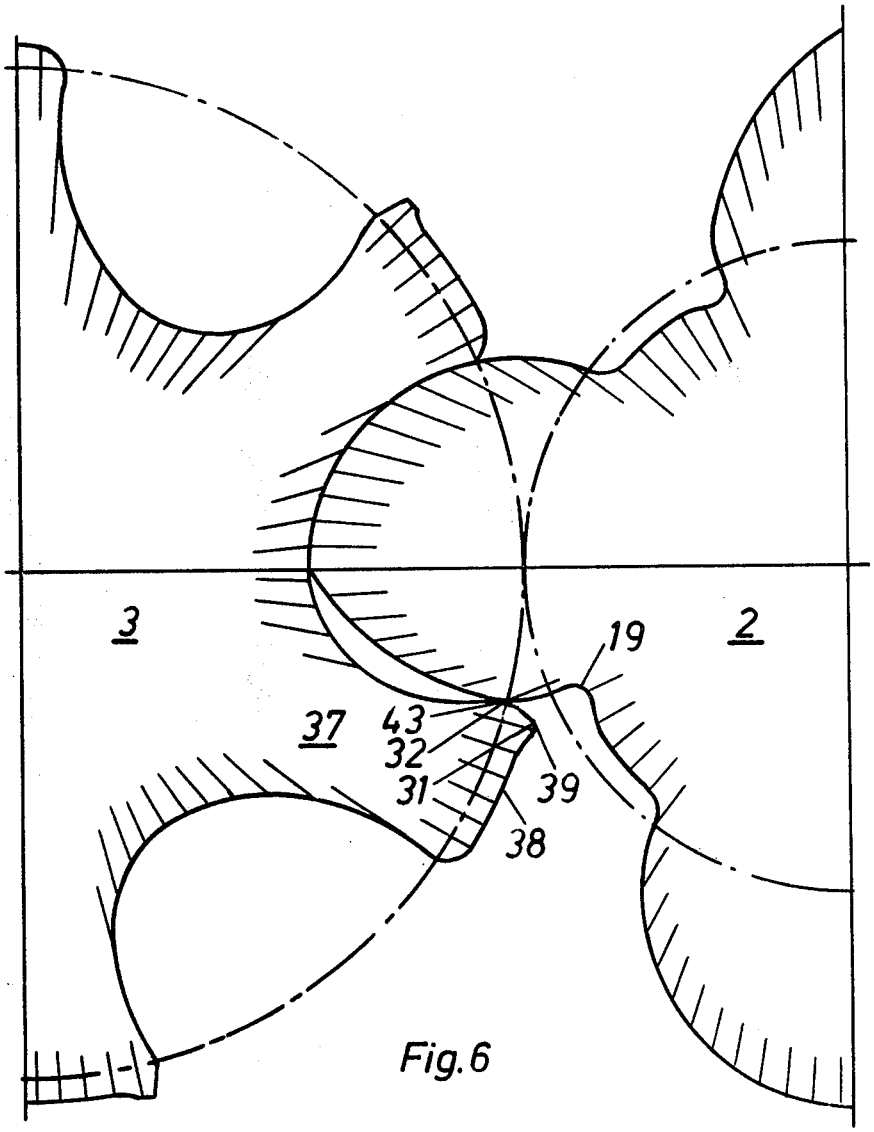
FIG. 6 is a fractional sectional view of a pair of rotors according to a second embodiment of the invention.

In the embodiment according to FIG. 6, the gate rotor land 37 is provided with a sealing ridge 39 at the transition between the crest 38 and the first flank of the gate rotor. One side of the sealing ridge 39 comprises the radially outermost portion of the section between the points 31 and 32 on the first flank of the gate rotor. The main rotor 2 is provided with a recess 19 for the sealing ridge 39. With this design of the gate rotor, a rotor provided with sealing ridges can be shaped to final form in a plurality of operations corresponding in number to the number of grooves in the gate rotor.

Figure 7:
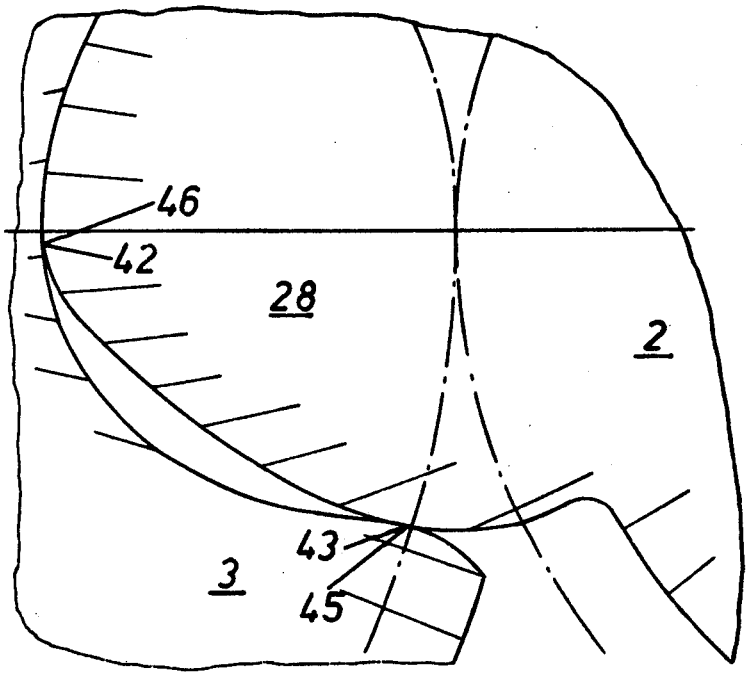
FIG. 7 is a fractional sectional view of a pair of rotors according to a third embodiment of the invention.

In the embodiment according to FIG. 7, the gate rotor 3 is provided with a rounded portion 45 as a transition between the first and second portions of the first flank. Furthermore, the main rotor 2 is provided with a rounded crest 46. With these rounded portions so-called "travelling generation" is obtained.

In the embodiment shown in FIG. 8, the section 22–23 deviates from a radial line at an angle $\nu$ of less than 20°. In the specific embodiment, the angle is approximately 15°. The length of the section 22–23 should be not less than 35% of the depth A of the dedendum and preferably 40%.

What we claim is:

1. A pair of cooperating rotors for a screw rotor machine comprising a main rotor having a dedendum and a gate rotor having an addendum, each provided with helical lands extending on both sides of respective pitch circles of the rotors and intervening grooves, said lands of the rotors having first and second flanks; said first flank of the gate rotor comprising a first portion extending from the bottom of the gate rotor groove substantially to the pitch circle of the gate rotor and being generated by the main rotor land and a second portion located outside the pitch circle of the gate rotor and extending substantially to the crest of the gate rotor; said first flank of the main rotor comprising a first portion located outside the pitch circle of the main rotor and a second portion (21–23) located inside the pitch circle of the main rotor, said second portion of the main rotor comprising a substantially radial section and a concavely curved section extending from said substantially radial section to the dedendum circle of the main rotor, said substantially radially extending section being greater than 35% of the distance between the pitch circle and the dedendum circle.

2. A pair of cooperating rotors for a screw rotor machine comprising a main rotor having a dedendum and a gate rotor having an addendum, each provided with helical lands extending on both sides of respective pitch circles of the rotors and intervening grooves, said lands of the rotors having first and second flanks; said first flank of the gate rotor comprising a first portion extending from the bottom of the gate rotor groove substantially to the pitch circle of the gate rotor and being generated by the main rotor land and a second portion located outside the pitch circle of the gate rotor and extending substantially to the crest of the gate rotor; said first flank of the main rotor comprising a first portion located outside the pitch circle of the main rotor and a second portion (21–23) located inside the pitch circle of the main rotor, said second portion of the main rotor comprising a substantially radial section and a concavely curved section extending from said substantially radial section to the dedendum circle of the main rotor, said substantially radial section describing an arc having a local radius at least three times greater than the local radius of said concavely curved section.

3. A pair of cooperating rotors for a screw rotor machine comprising a main rotor having a dedendum and a gate rotor having an addendum, each provided with helical lands extending on both sides of respective pitch circles of the rotors and intervening grooves, said lands of the rotors having first and second flanks; said first flank of the gate rotor comprising a first portion extending from the bottom of the gate rotor groove substantially to the pitch circle of the gate rotor and being generated by the main rotor land and a second portion located outside the pitch circle of the gate rotor and extending substantially to the crest of the gate rotor; said first flank of the main rotor comprising a first portion located outside the pitch circle of the main rotor and a second portion (21–23) located inside the pitch circle of the main rotor, said second portion of the main rotor comprising a substantially radial section and a concavely curved section extending from said substantially radial section to the dedendum circle of the main rotor, said substantially radial section comprising a straight line portion.

4. A pair of cooperating rotors according to claim 3, in which said straight line portion is directed towards the center of rotation of the main rotor.

5. A pair of cooperating rotors for a screw rotor machine comprising a main rotor having a dedendum and a gate rotor having an addendum, each provided with helical lands extending on both sides of respective pitch circles of the rotors and intervening grooves, said lands of the rotors having first and second flanks; said first flank of the gate rotor comprising a first portion extending from the bottom of the gate rotor groove substantially to the pitch circle of the gate rotor and being generated by the main rotor land and a second portion located outside the pitch circle of the gate rotor and extending substantially to the crest of the gate rotor; said first flank of the main rotor comprising a first portion located outside the pitch circle of the main rotor and a second portion (21–23) located inside the pitch circle of the main rotor, said second portion being profiled so that a tangent to said second portion through an arbitrary point on said portion deviates at an angle of less than 20° from a radius from the center of said main rotor through said arbitrary point at every position of said arbitrary point between the pitch circle of the main rotor and a point located two-thirds of the distance from the pitch circle and the dedendum circle.

6. A pair of cooperating rotors according to claim 5, in which said first portion of the gate rotor is generated by the crest of the main rotor lands.

7. A pair of cooperating rotors according to claim 6, in which said crest of the main rotor land comprises a sharp corner.

8. A pair of cooperating rotors according to claim 6, in which said crest of the main rotor land comprises a smoothly rounded transition between said first and second flanks of the main rotor land.

9. A pair of cooperating rotors according to claim 5, in which said first portion of the main rotor is generated by a transition between said first and second portions of the gate rotor.

10. A pair of cooperating rotors according to claim 9, in which said transition between said first and second portions of the first flank of the gate rotor comprises a sharp corner.

11. A pair of cooperating rotors according to claim 9, in which said transition between said first and second portions of the first flank of the gate rotor comprises a rounded portion.

12. A pair of cooperating rotors according to claim 5, in which said second portion of the main rotor comprises a substantially radial section and a concavely curved section extending from said substantially radial section to the dedendum circle of the main rotor.

13. A pair of cooperating rotors according to claim 12, in which said second portion of the gate rotor is generated by said substantially radial section.

14. a pair of cooperating rotors according to claim 12, in which said second portion of the gate rotor comprises a sharp corner at its outermost extreme.

15. A pair of cooperating rotors according to claim 14, in which the gate rotor land is provided with a radially directed sealing ridge one side of which constitutes the radially outermost portion of said second portion of the gate rotor.

16. A pair of cooperating rotors according to claim 14, in which said sharp corner generates said curved section of the first flank of the main rotor.

* * * * *